US005713172A

United States Patent [19]

Tegland

[11] Patent Number: 5,713,172

[45] Date of Patent: Feb. 3, 1998

[54] STORAGE FLOOR AIR VENT AND METHOD OF ITS USE

[76] Inventor: Howard Lynn Tegland, 1243 Reser Rd., Walla Walla, Wash. 99362

[21] Appl. No.: 553,108

[22] Filed: Nov. 3, 1995

[51] Int. Cl.[6] ..... E04F 17/04

[52] U.S. Cl. ..... 52/302.3; 52/169.5; 52/220.8; 52/302.1; 454/174

[58] Field of Search ..... 454/174, 179, 454/180, 182; 52/302.3, 302.4, 169.5, 220.8, 302.1

[56] References Cited

U.S. PATENT DOCUMENTS 2,202,147 5/1940 Gerriets .
5,451,081 9/1995 Kaucnik ..... 52/220.8 X
5,460,572 10/1995 Waltz et al. ..... 52/302.1 X
5,496,213 3/1996 Miller ..... 52/302.1 X
5,542,223 8/1996 Inda et al. ..... 52/302.3 X

*Primary Examiner*—Wynn E. Wood
*Assistant Examiner*—Timothy B. Kang
*Attorney, Agent, or Firm*—Floyd E. Ivey

[57] ABSTRACT

The present invention relates to atmospheric control in commodity storage buildings and in particular to the air flow floor vents installed during construction of concrete floors and employed in the control of flow and or circulation of air or atmosphere from under-floor plenums via vents around fruits and or vegetables, including in particular fresh potatoes, stored on concrete or other floors following harvest and until sale and or processing.

14 Claims, 5 Drawing Sheets

STORAGE FLOOR AIR VENT AND METHOD OF ITS USE

FIELD FOR THE INVENTION

The present invention relates generally to floor air vents and relates in particular to air vents which may be installed during construction in concrete floors where fresh fruits and vegetables, including in particular potatoes and onions, are stored pending processing and or other disposition where such air vents are a part of a controlled atmosphere system intended to prolong the storage life of such food products or produce by the circulation of forced air/atmosphere.

BACKGROUND OF THE INVENTION

Certain fresh vegetables and fruits may be stored in bulk in buildings with controlled atmospheres including circulation of the atmosphere, including air, for the purpose of retaining produce freshness or decreasing the time within which produce spoilage might occur. Vegetables and fruits so stored are unloaded in bulk onto the building floor and, when removed, are removed from the building floor. The floor construction employed wood slots placed over concrete slabs separated by plenums (spaces between the concrete slabs wherein the air pressure is greater than the air pressure within the building) spaced 6' apart from the centers of the plenums. Air, or other controlled atmosphere gases, was forced into the plenums and through the wood slots and thus circulated throughout the stored bulk vegetables or fruit. The typical commodity storage facility floor will have thousands of such air vent slots. The wood slots created an uneven floor surface making it difficult to load and unload bulk produce and to clean the storage building. The combined need for atmospheric circulation in such storage and the difficulties encountered in loading, unloading and cleaning created a need for a different floor/vent system.

An attempt to achieve a continuous concrete slab construction with floor slots was undertaken with the use of STYROFOAM plugs. Rectangular plenum structures were formed of concrete on 6' centers and were covered with metal sheets with cutouts which would accept the lower end of a STYROFOAM plug. Multiple STYROFOAM plugs were fixed in place in the cutouts by wiring to the reinforced iron bed in preparation for the pouring of a continuous concrete slab floor. Concrete was poured to a depth which covered the STYROFOAM plugs sufficient to permit concrete finishing. The thickness of the covering of concrete over the STYROFOAM plug was such as to allow a workman to break the covering to gain access to the STYROFOAM plug. With the concrete covering removed the STYROFOAM plug was then broken out leaving an air vent slot from the floor surface to the air/atmosphere plenum. This method of forming air vent slots produced satisfactory slots but proved unduly expensive with regard to the labor required for the breaking up of and removal of the STYROFOAM plugs. There is no known related art to disclose in accordance with 37 CFR 1.97.

SUMMARY OF THE INVENTION

In accordance with the present invention, a thermoplastic shell is disclosed as a Potato Storage Floor Air Vent. The present invention comprises an improvement to known floor air vent structures through the dual functions of first, permitting the efficient pouring of continuous concrete slab floors with, second, the introduction of a plurality of floor air vents through the continuous concrete slab between the slab floor surface and circulation air/atmosphere plenums without taking the steps of separately constructing forms for each flow air vent.

The preferred embodiment of the improvement is an apparatus in the form of a shell of any rigid or semi-rigid thermoplastic material having a rectangular cross section in plan view and a thin STYROFOAM blockout affixed at the top shell opening. The shell may be formed of any material having sufficient material strength to resist the force of poured concrete, thus retaining the vent form shape. The blockout may be formed of any material which can resist the force of concrete and be easily removed by a workman following the curing of the concrete floor.

The shell disclosed herein is formed of polystyrene having a typical wall thickness of 1/16", a rectangular cross section in plan view, a shell bottom opening inside diameter of 3.5"×17/16" and a shell top opening inside diameter of 7"×19/16". The shell back side separates the shell bottom and top openings by 5" and is orthogonal to both the shell bottom and top openings. The shell front side forms an acute angle with the shell top opening and an obtuse angle with the shell bottom opening. A mounting flange, having reinforcing gussets, projecting orthogonally from the shell 1¼" wide is located ¼" from the shell bottom opening on both the first and second shell sides. The ¼" shell between the shell bottom opening and the mounting flange is a locating protrusion. The locating protrusion is received into an appropriately dimensioned slot in a metal sheet, which covers the area in the concrete forms which will be a plenum, with the shell then secured either by screwing the mounting flange to the metal sheet or by wiring the shell to adjacent reinforcing iron. First and second reinforcing or stiffening ribs are positioned intermediate the mounting flange and the shell top opening 1¼" and 2.828" respectively from the shell top opening. The reinforcing or stiffening ribs provide structural strength to the shell and serve to anchor the shell in the concrete slab. There must be no flange or rib structure at the shell top opening inasmuch as such structure may be contacted by vehicle tires and subjected to twisting thus causing shell fracturing and destruction. A STYROFOAM plug, to prevent concrete from entering the shell and plenum during pouring, is dimensioned to fit into the shell top opening, is approximately ¾" thick and is affixed and remains within the shell top opening during the pouring of the concrete slab.

The air vent disclosed may be of a variety of dimensions, shapes and cross-sections depending on the metering function required of the vent and the character of the bulk commodity or other material to be stored. The air vent size and configuration regulate the air flow in velocity and capacity. The configuration disclosed herein has a shell top opening approximately twice the size of the shell bottom opening as a means of addressing the problem of bulk commodities covering and partially constricting air flow through the air vent. The shell back side is orthogonal in relation to the shell top and bottom openings, as opposed to the acute angle relationship of the shell front side to the shell top opening as a means of limiting the ability of produce waste from entering and blocking the shell or falling into the plenum. The mounting flanges or other mounting means need not be limited to an orthogonal relationship with the shell sides or surface but may be positioned for convenience in accordance with construction techniques employed. The Potato Storage Floor Air Vent thus disclosed is simple in installation for the forming of a concrete slab floor and for the removal of the STYROFOAM blockout. The invention facilitates the construction of the concrete floor slab required for ease in loading and unloading of bulk commodities and in cleanup of such storage facilities.

BRIEF DESCRIPTION OF THE DRAWINGS

The foregoing and other features and advantages of the present invention will become more readily appreciated as the same become better understood by reference to the following detailed description of the preferred embodiment of the invention when taken in conjunction with the accompanying drawings, wherein.

DETAILED DESCRIPTION

Figure 1:
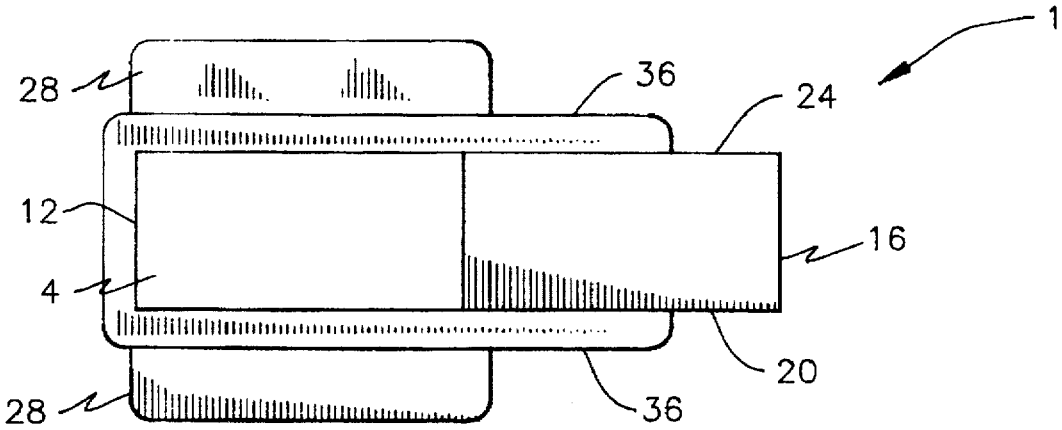
FIG. 1 is a top plan view of the Potato Storage Floor Air Vent showing the shell top and bottom opening, the mounting flange and first and second reinforcing ribs.
Figure 2:
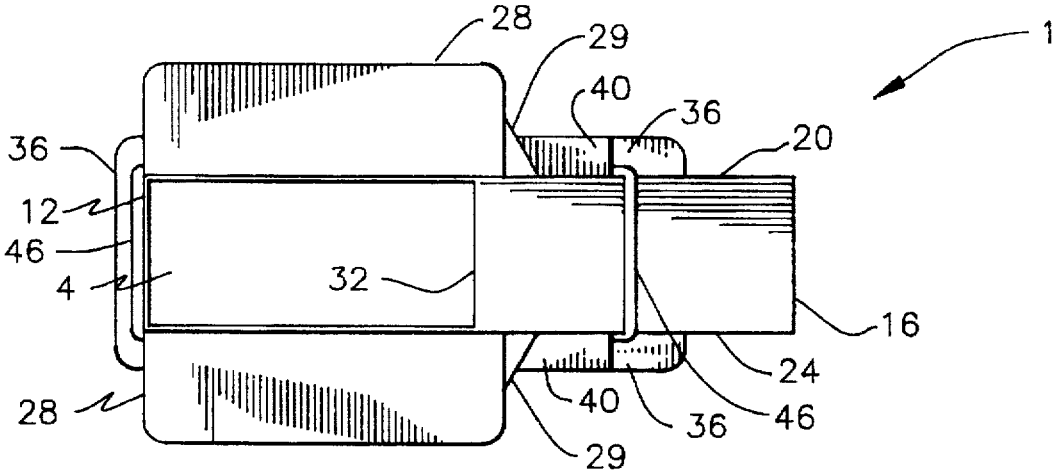
FIG. 2 is a bottom plan view showing the shell bottom opening, the mounting flanges, the first and second reinforcing ribs, the shell front side, and the locating protrusion.
Figure 3:
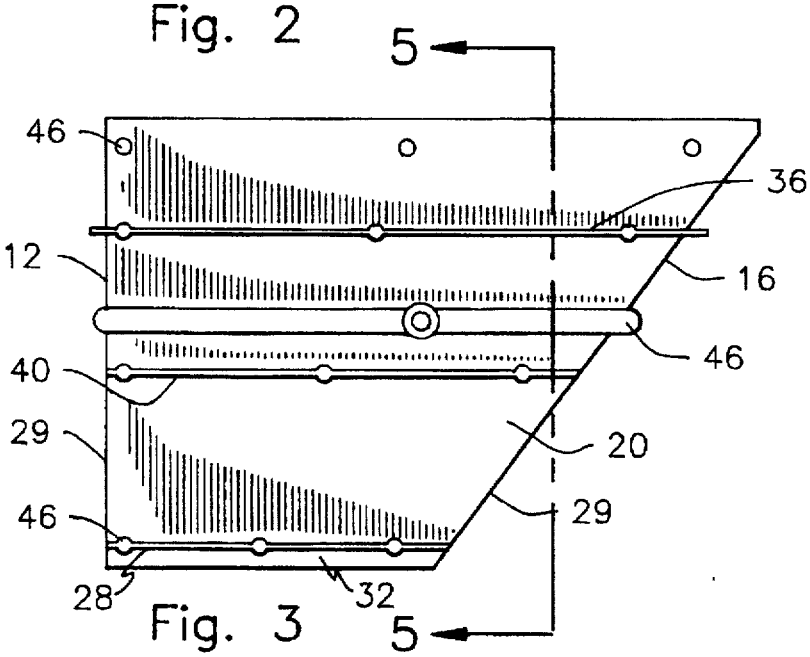
FIG. 3 is an elevation first side view showing the shell first side, the shell front and back sides, the first and second reinforcing ribs, the mounting flange and reinforcing gussets, the locating protrusion and injection molding artifacts.
Figure 6A:
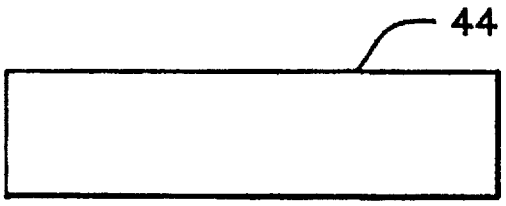
FIGS. 6A, 6B, and 6C show plan, elevation and end views of the STYROFOAM blockout.
Figure 6C:
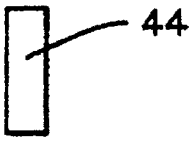
Figure 6B:
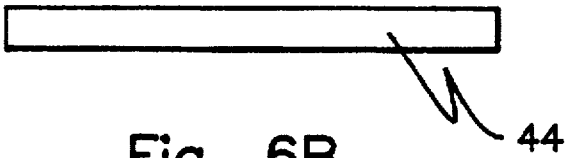
Figure 4:
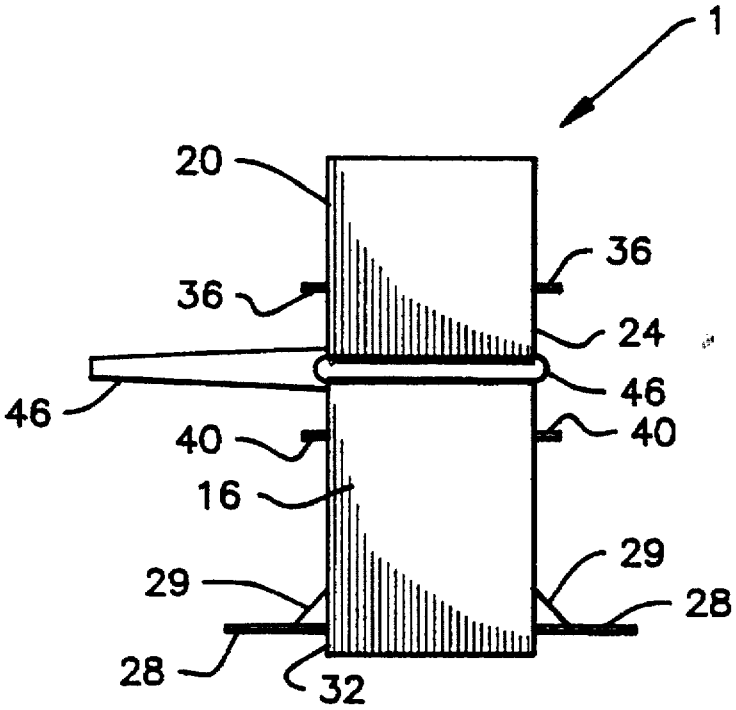
FIG. 4 is an elevation front side view.
Figure 5:
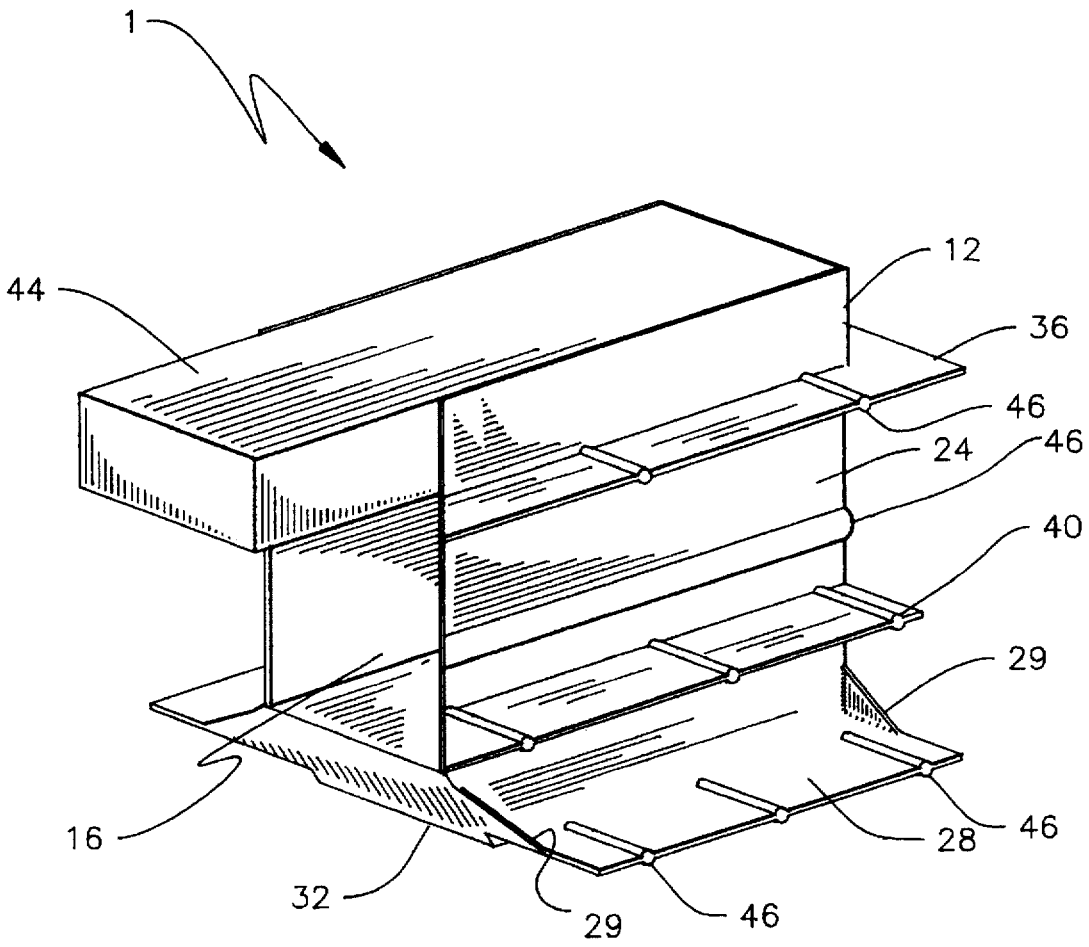
FIG. 5 is a partial section 5—5 of FIG. 3 showing the position of the STYROFOAM blockout in place.
Figure 7:
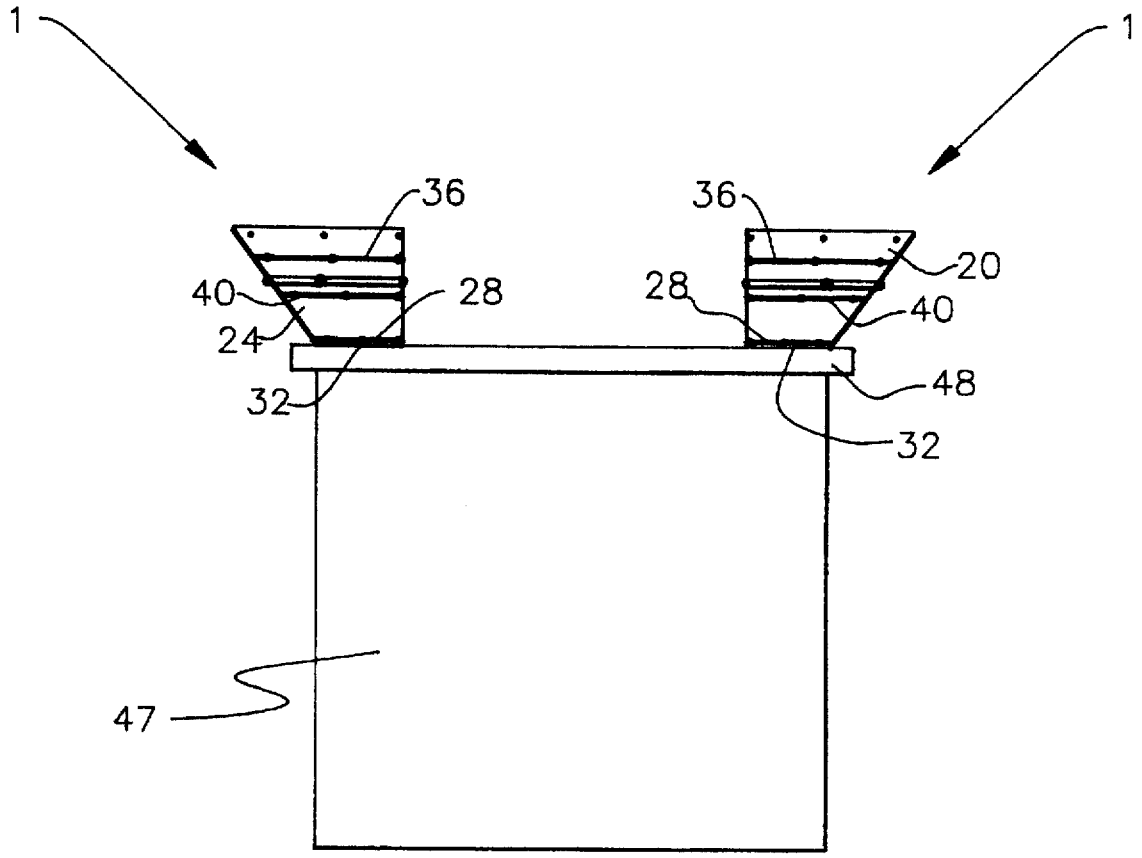
FIG. 7 shows the relationship of the Potato Storage Floor Air Vent to the plenum and metal sheet when installed.
Figure 8:
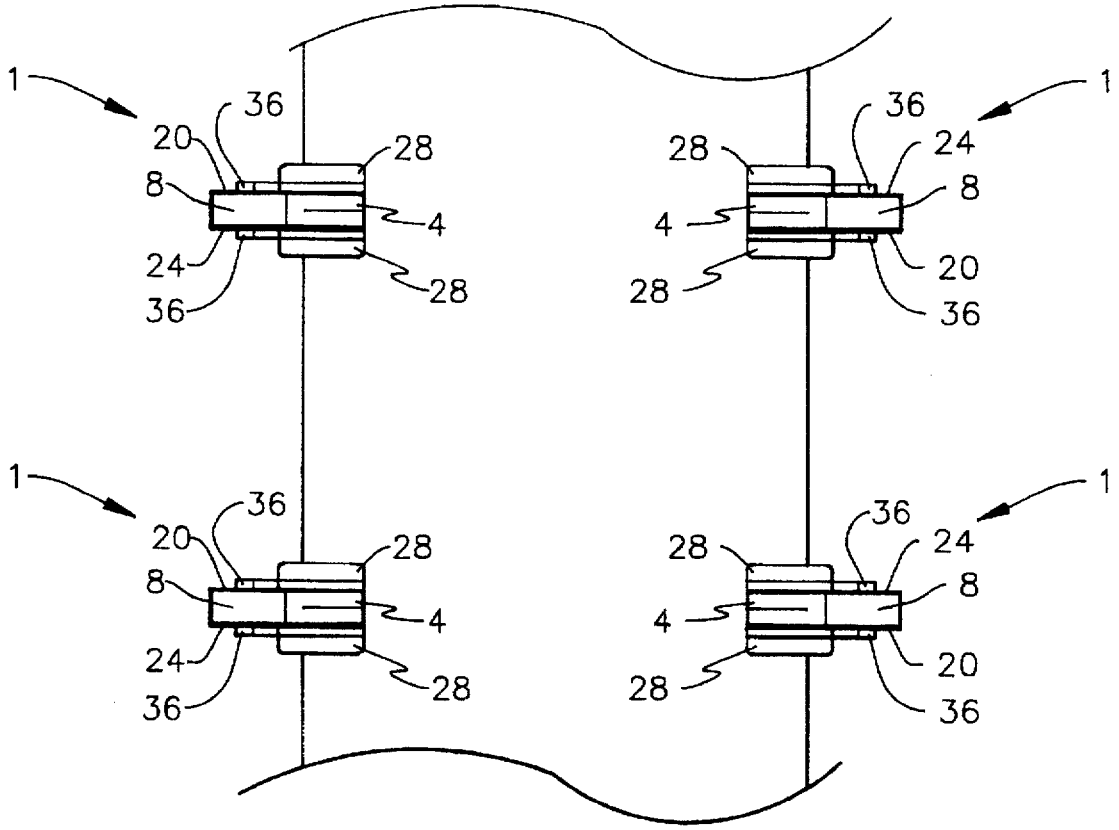
FIG. 8 shows a plurality of Potato Storage Floor Air vents as they would appear in place within metal sheet cutouts and ready for the pouring of a continuous concrete slab floor.

The Potato Storage Floor Air Vent of FIGS. 1, 2, 3, 4 and 5 illustrate and is the preferred embodiment wherein a Potato Storage Floor Air Vent 1 is a thermoplastic shell having a shell back and front side 12, 16, and a shell first and second side 20, 24; the four sides, consisting of the shell back, first, front and second sides 12, 20, 16, 24 combining respectively to enclose therein a shell cavity 3 wherein the Potato Storage Floor Air Vent 1 has essentially a rectangular cross-section in plan view; the shell cavity having at one end a shell bottom opening 4 and at the other end a shell top opening 8; a mounting flange 28 protrudes from and is orthogonal to each of the shell first and second sides 20, 24 and orthogonal to the shell back side 12; reinforcing gussets 29 distal from the shell bottom opening 4 extend from the shell first side 20 to the mounting flange 28 and from the shell second side 24 to the mounting flange 28 and provide structural strength to the mounting flange; a locating protrusion 32 formed between the mounting flange 28 and the shell bottom opening 4; a first and second reinforcing rib 36, 40 on both the shell first and second side 20, 24 orthognal to both the first and second sides 20, 25 and to the shell back side 12 and proximal and distal, respectively from the shell top opening 8; a STYROFOAM blockout 44, essentially rectangular in plan and elevation, is shown in FIGS. 6A, 6B and 6C and is dimensioned to be accepted into the shell top opening 8 to prevent concrete from entering the shell cavity 3; the locating protrusion 32 received into a slot in a metal sheet 48 which in turn covers an area to be a plenum 47 upon pouring a continuous concrete slab as illustrated in FIGS. 7 and 8. Injection molding artifacts 46 are found on the injection molded Potato Storage Floor Air Vent.

While a preferred embodiment of the present invention has been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A Storage Floor Air Vent comprising:

A. a shell having a shell back and front side and a shell first and second side; the four sides, consisting of the shell back, first, front and second sides combining respectively to enclose therein a shell cavity;

B. the shell cavity having at one end a shell bottom opening and at the other end a shell top opening; a pair of mounting flanges proximal to the shell bottom opening; said mounting flanges protrude from each of the shell first and second sides;

C. a locating protrusion formed between the mounting flange and the shell bottom opening; a first and second reinforcing rib on both the shell first and second sides generally orthogonal to both the first and second sides and to the shell back side and intermediate the shell bottom opening and, the shell top opening;

D. a blockout dimensioned to be accepted into the shell top opening to prevent concrete from entering the shell cavity; the locating protrusion capable of being received into a slot in a metal sheet which in turn covers an area to be a plenum upon pouring a continuous concrete slab.

2. A Storage Floor Air Vent according to claim 1 composed of a rigid or semi-rigid thermoplastic material.

3. A Storage Floor Air Vent according to claim 1 composed of a rigid or semi-rigid material.

4. A Storage Floor Air Vent according to claim 1 wherein the Potato Storage Floor Air Vent has essentially a rectangular cross-section in plan view and accepts blockout essentially rectangular in plan and elevation.

5. A Storage Floor Air Vent according to claim 1 wherein the blockout is formed of a light resilient polystyrene plastic.

6. The vent according to claim 1 wherein the blackout is formed of plastic foam.

7. The vent according to claim 1 wherein the blackout is formed of plastic.

8. A Storage Floor Air Vent comprising;

A. a shell having a shell cavity;

B. the shell cavity having at one end a shell bottom opening and at the other end a shell top opening; mounting means affixed to the shell to anchor the shell during the pouring of concrete;

C. positioning means formed to position the shell during the pouring of concrete; the positioning means receivable into a slot in a form which in turn covers a plenum upon pouring a continuous concrete slab;

D. a block out dimensioned to be accepted into the shell top opening to prevent concrete from entering the shell cavity; the block out further having having as a thickness of sufficient strength to support a concrete layer upon it, yet sufficiently fragile to permit removal by breaking with a hammer.

9. A Storage Floor Air Vent according to claim 8 composed of a rigid or semi-rigid thermoplastic material.

10. A Storage Floor Air Vent according to claim 8 composed of a rigid or semi-rigid material.

11. A Storage Floor Air Vent according to claim 8 wherein the blockout is formed of a light resilient polystyrene plastic.

12. The vent according to claim 8 wherein the blockout is formed of plastic foam.

13. The vent according to claim 8 wherein the blockout is formed of plastic.

14. Method for installing floor vent comprising the steps of:

A. forming at least one rectangular plenum structure;

B. a plurality of slots in metal sheets; said metal sheets covering the at least one plenum structure;

C. placing a storage floor air vent of claim 1 having a blockout, locating protrusion and a mounting flange, via the locating protrusion, into each of the plurality of slots in the metal sheets; securing the storage floor air vent to the metal sheet by a sheet metal screw connection between the mounting flange and the metal sheet;

D. covering the floor area, encompassing the metal sheets with storage floor air vents, with a concrete slab covering the storage floor air vents sufficiently to permit concrete finishing;

E. breaking through and removing the concrete surface above each storage floor air vent and the block out permitting passage of air through the storage floor air vent into the storage area.

* * * * *